US006705785B1

(12) United States Patent
White

(10) Patent No.: US 6,705,785 B1
(45) Date of Patent: Mar. 16, 2004

(54) APPARATUS FOR REMOVING PERFORATED SIDE EDGE GUIDE STRIPS FROM PRINTER PAPER

(76) Inventor: Richard White, R.R. 1, Box 131, Glen Elder, KS (US) 67446

( * ) Notice: Subject to any disclaimer, the term of this patent is extended or adjusted under 35 U.S.C. 154(b) by 0 days.

(21) Appl. No.: 10/361,133

(22) Filed: Feb. 6, 2003

(51) Int. Cl.[7] ..... B41J 11/26; B26F 3/00

(52) U.S. Cl. ..... 400/621.1; 101/227; 225/99; 225/106

(58) Field of Search ..... 400/621, 621.1, 400/616; 101/227, 226; 225/93, 99, 106; 83/422, 423, 425, 431.1

(56) References Cited

U.S. PATENT DOCUMENTS

| | | | | | |
|---|---|---|---|---|---|
| 2,171,769 | A | * | 9/1939 | Stolar et al. | 225/99 |
| 2,188,347 | A | | 1/1940 | Fulk | |
| 4,423,975 | A | * | 1/1984 | Krenz | 400/621.1 |
| 4,782,986 | A | * | 11/1988 | Loesche | 225/106 |
| 4,991,760 | A | * | 2/1991 | Coryell | 225/106 |
| 5,007,571 | A | * | 4/1991 | Nasby et al. | 225/106 |
| 5,072,869 | A | * | 12/1991 | Padgett | 225/106 |
| 5,102,246 | A | | 4/1992 | Patz | 400/621.1 |
| 5,120,144 | A | | 6/1992 | Lund | 400/621.1 |
| 5,259,543 | A | | 11/1993 | Downing | 225/99 |
| 5,346,321 | A | | 9/1994 | Eudy | 400/621.1 |
| 5,357,832 | A | * | 10/1994 | Ferguson | 83/423 |
| 5,368,404 | A | | 11/1994 | Hacker | 400/621.1 |
| 5,505,551 | A | | 4/1996 | Rutherford | 400/621 |
| 5,516,221 | A | | 5/1996 | Lake | 400/621.1 |
| 5,634,581 | A | | 6/1997 | Taylor | 225/93 |
| 5,791,540 | A | * | 8/1998 | Sage | 205/106 |
| 6,585,438 | B2 | * | 7/2003 | Hosokawa et al. | 400/621.1 |

FOREIGN PATENT DOCUMENTS

| | | |
|---|---|---|
| AU | 241251 | 3/1960 |

* cited by examiner

*Primary Examiner*—Eugene H. Eickholt
(74) *Attorney, Agent, or Firm*—Jeffrey L. Thompson; Thompson & Thompson, P.A.

(57) ABSTRACT

A guide strip removal system includes a pair of guide strip removal devices positioned on opposite sides of a printer outlet where a continuous sheet of paper is discharged. The guide strip removal devices each include a pair of plate members secured together in a spaced apart parallel relationship to define a narrow slot therebetween. The plate members each have a corner portion delineated from a planar main body portion by respective narrow slits that extend from front edges of the plate members toward rear edges thereof. The corner portions are angled away from the main body portions to create paths for the side edge guide strips that diverge abruptly away from paths for the marginal side edge portions of the printer paper. The side edge guide strips are thereby removed from the marginal side edge portions of the, paper without the use of any moving parts or cutting blades.

20 Claims, 2 Drawing Sheets

APPARATUS FOR REMOVING PERFORATED SIDE EDGE GUIDE STRIPS FROM PRINTER PAPER

BACKGROUND OF THE INVENTION

1. Field of the Invention

The present invention relates generally to tractor feed printers and, in particular, to devices for separating the side edge guide strips on the sides of tractor-fed printer paper from the main body of the paper.

2. Description of the Related Art

Many printers connected to computers print on a continuous sheet of paper, such as business invoices and the like. The continuous sheet of paper can be separated into individual sheets of paper when desired by tearing the continuous sheet along longitudinally-spaced and transversely-extending lines of perforations. The continuous sheet of paper is fed through the printer by means of side edge guide strips which are formed on opposite sides of the continuous sheet. The side edge guide strips have holes which extend along their lengths at regularly spaced-apart intervals which match the spacing of sprocket teeth on peripheral surfaces of sprocket wheels which are positioned on opposite sides of the printer. The sprocket wheels are driven to provide a tractor feed mechanism for feeding the paper through the printer.

The side edge guide strips are usually manually torn from the opposite sides of the individual sheets of paper after the individual sheets are torn from the continuous sheet of paper. This can be a tedious and time-consuming task. Solutions have been proposed in the prior art to perform this task automatically,. For example, U.S. Pat. No. 2,188,347 issued to Fulk discloses a cutting device for cutting strips from the side edge of a continuous paper form using a cutting blade. U.S. Pat. No. 5,102,246 issued to Patz discloses a device for removing the side edges of a paper web which uses a U-shaped housing having a feed slot and a rotating cutting disk mounted within the slot. U.S. Pat. No. 5,120,144 issued to Lund discloses a paper separator that has a tractor feed mechanism that causes a divergence in the paths of the body of the paper form and the side edge strip to cause separation. U.S. Pat. No. 5,259,543 issued to Downing discloses a parting tool for a tractor feed printer that uses a blade intersecting the plane of the paper for shaving the paper along the perforations connecting the guide strip to the sheets of paper. U.S. Pat. No. 5,346,321 issued to Eudy discloses an edge strip trimmer that uses an edge strip hold-down device to remove the edge strips by progressively diverging the plane of the edge strip from the plane of the paper sheet as the paper sheets are fed through the printer.

Various other proposed solutions are disclosed by U.S. Pat. No. 5,368,404 issued to Hacker, U.S. Pat. No. 5,505,551 issued to Rutherford, U.S. Pat. No. 5,516,221 issued to Lake, U.S. Pat. No. 5,634,581 issued to Taylor, and Australian Patent No. 241,251 issued to Castleton. All of these prior art solutions tend to be overly complicated and expensive, and many require knife blades, rollers, or other elements requiring maintenance. Thus, there is a need in the industry for an improved device to separate and remove side edge guide strips from printer paper.

SUMMARY OF THE INVENTION

An object of the present invention is to provide a simpler yet highly reliable device to separate and remove the side edge guide strips from computer paper as it leaves the printer.

A further object of the present invention is to provide a paper strip removal device that can be installed quickly and easily to existing computer printers.

It is a further object of the present invention to provide a paper strip removal device that is economical to manufacture, efficient and reliable in use, capable of a long operating life, and particularly well suited for use with existing tractor-fed printers.

To accomplish these and other objects, a paper strip removal device for removing side edge guide strips from tractor-fed computer printer paper is provided by the present invention. The paper strip removal device has first and second plate members rigidly attached together in a spaced apart parallel relationship to one another so as to define a narrow slot therebetween wide enough to receive a marginal side edge portion of a printer paper with its side edge guide strip thereon through the slot. The plate members each have a planar main body portion and a corner portion separated from the main body portion by a narrow slit that extends from a front edge of the plate member toward a rear edge thereof. The corner portions are angled downwardly away from the planar main body portions to create a path for the side edge guide strip that diverges abruptly from a path created by the main body portions for the marginal side edge portion of the printer paper. The diverging paths cause the side edge guide strip to be removed from the marginal side edge portion without using a cutting blade or other moving parts.

Numerous other objects and advantages of the present invention will be apparent to those skilled in this art from the following description wherein there is shown and described a preferred embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENT

A device 10 for removing perforated side edge guide strips from printer paper according to the present invention will now be described with reference to FIGS. 1 to 5 of the accompanying drawings.

Figure 1:
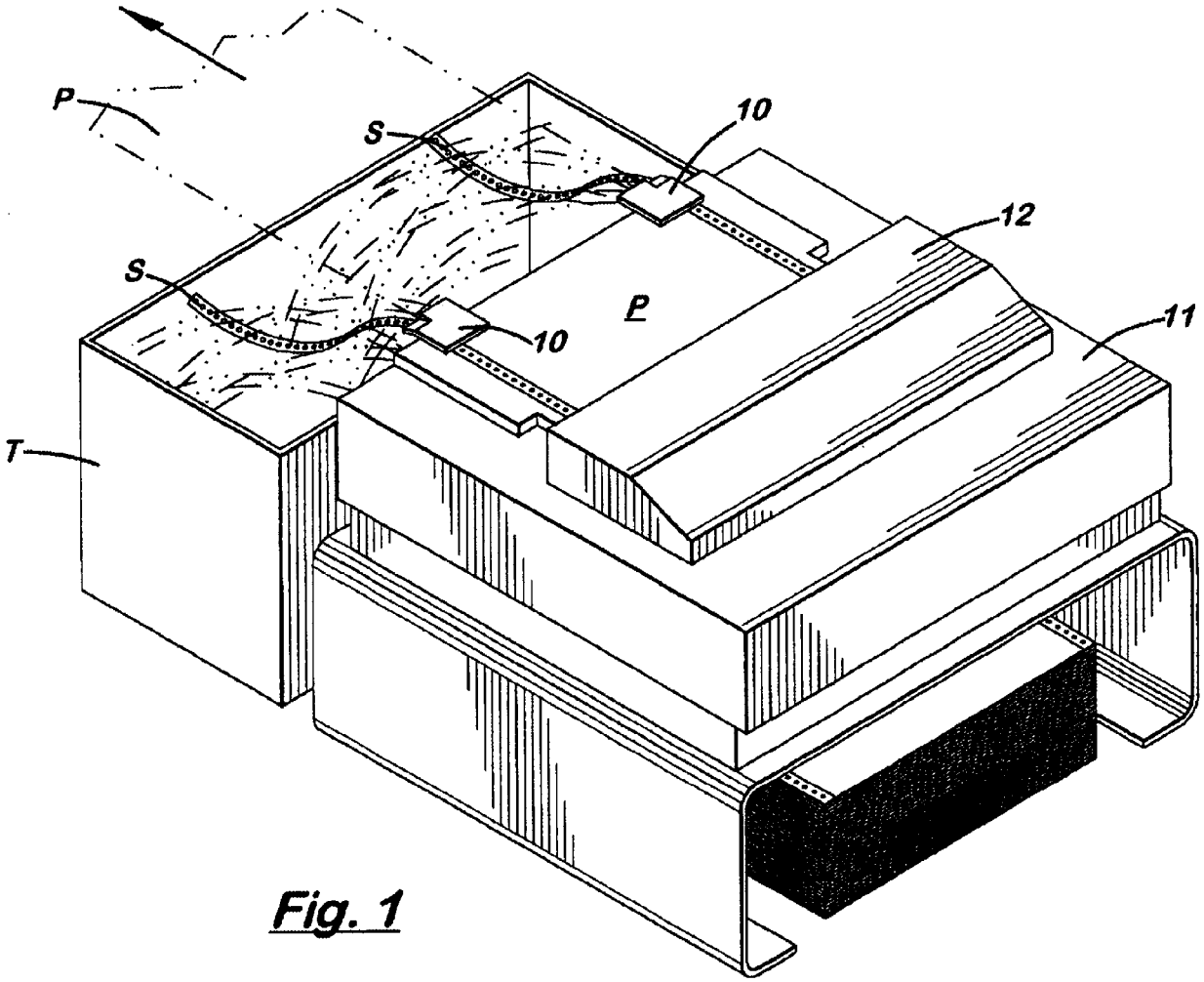
FIG. 1 is a perspective view of a printer equipped with a system for removing perforated side edge guide strips from printer paper according to the present invention.

FIG. 1 shows a printer 11 equipped with a pair of strip removal devices 10 attached to each side of a paper outlet 12 of the printer 11 The printer 11 is shown printing on a continuous sheet of paper P, such as business invoices and the like. The continuous sheet of paper P has side edge guide strips S formed on opposite side edges E of the continuous sheet of paper P, which are used to feed the paper P through the printer 11. The side edge guide strips S have holes 13 at regularly spaced-apart intervals that match the sprocket teeth (not shown) in the printer 11.

The perforated strip removal device 10 of the present invention operates to remove the perforated side edge guide strips S from along the side edges E of the continuous sheet of printer paper P as the paper is discharged from the outlet 12. The strip removal devices 10 are positioned to direct the removed strips S into a separate waste container T. The perforated strip removal device 10 includes first and second plate members 15 which are generally rectangular in shape, and a means 16 for rigidly, and preferably integrally, attaching the plates 15 to one another. Each of the plates 15 has a pair of opposite faces 17, 18, front and rear edges 19, 20, and a pair of opposite side edges 21, 22 extending between and interconnecting the front and rear edges 19, 20.

The means 16 for rigidly attaching the plates 15 to one another is a segment 16 that extends only along one side edge 21 of the opposite side edges 21, 22 thereof. In the preferred embodiment, the plates 15 are integrally formed of plastic material and a single plate member is folded back on itself to create the segment 16. The plates 15 are supported in a spaced apart parallel relationship to one another so as to define a narrow slot 23 therebetween wide enough to receive a marginal side edge portion M of a printer sheet P with its perforated side edge guide strip S thereon through the slot 23 with the sheet P extending beyond the rear edges 20 and other side edge 22 of the plates 15.

Each of the plates 15 have a planar main body portion 34 and a front corner portion 25 delineated from the main body portion 34 by a narrow slit 24. The narrow slit 24 extends between the opposite faces 17, 18 of each plate 15, and runs perpendicularly from the front edge 19 a short distance toward the rear edge 20 thereof. The slits 24 are spaced between the opposite side edges 21, 22 thereof so as to define right corner portions 25 on each plate 15 which are aligned with each other. Each front corner portion 25 has a width $W_1$ between the slit 24 and attached ones of the opposite side edges 21 of the plates 15 which is slightly larger than the width $W_2$ of the perforated side edge guide strip S on the printer sheet P. When the printer sheet P is moved through the slot 23 between the plates 15, its perforated side edge guide strip S will move in longitudinal alignment with the front corner portions 25 of the plates 15, and its marginal side edge portion M will move in longitudinal alignment with corners 26 of the main body portion 34 of the plates 15, which are separated from the front corner portions 25 by the slits 24.

The front corner portions 25 of the plates 15 are bent downwardly about a bend line 30, which extends generally perpendicular to the slits 24. The corner portions 25 are bent about the bend line 30 to diverge from the main body portions 34 at an angle of about 20 to 45 degrees. The corner portions 25 are bent in the same directions from the respective planes of the main body portions 34 of the plates 15 to maintain the slot 23 therebetween. When the marginal side edge portion M of the printer sheet P and its perforated side edge guide strip S are pulled through the slot 23 between the plates 15 their paths will diverge abruptly from one another as a result of the bend line 30 and the narrow slit 24 between the main body portions 34 and the front corner portions 25. This abrupt divergence of the paths causes a tearing and separation of the perforated side edge guide strip S from the marginal side edge portion M of the printer sheet P along a line of perforations L therebetween.

Figure 2:
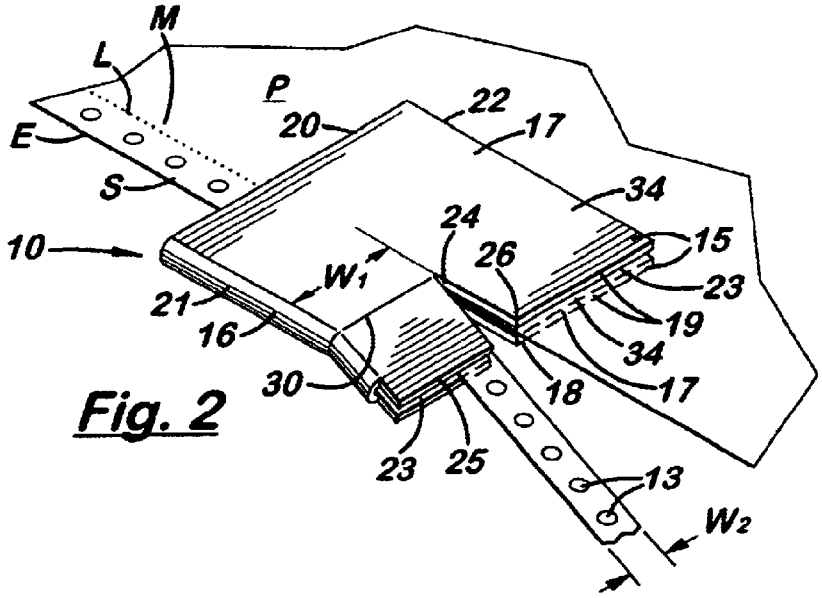
FIG. 2 is a perspective view of one of the paper strip removal devices for removing perforated side edge guide strips from printer paper according to the present invention.
Figure 3:
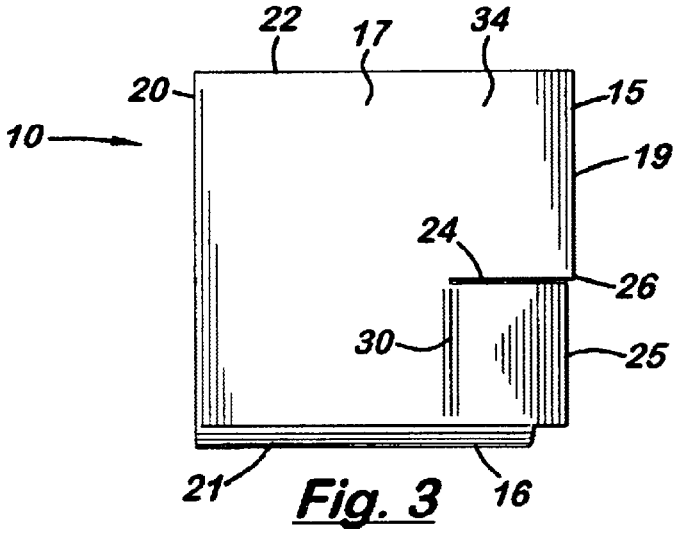
FIG. 3 is a plan view of the paper strip removal device according to the present invention.
Figure 4:
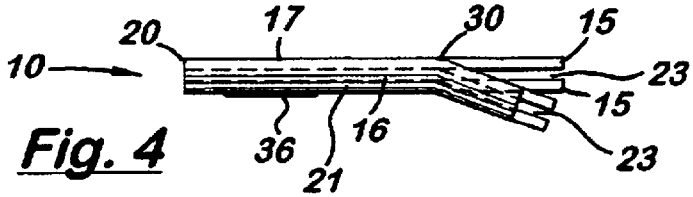
FIG. 4 is an outer side view of the paper strip removal device according to the present invention.
Figure 5:
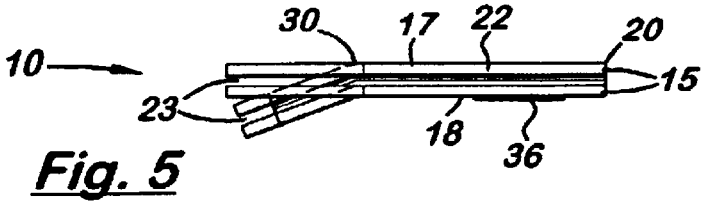
FIG. 5 is an inner side view of the paper strip removal device according to the present invention.

The corner portion 25 of the top plate 15, as shown in FIGS. 2 to 4, has an inner edge 35 defined by the slit 24. The inner edge 35 passes closely across an outer edge of the narrow slot 23 formed between the main body portions 34 of the plates 15 and creates a shearing mechanism to facilitate removal of the side edge guide strips S from the marginal side edge portion M.

Peel-off adhesive backing strips 36 can be provided on the lower one of the plates 15 for quick and easy mounting of the device 10, without the use of tools, to the printer 11. The device 10 can be fabricated for both left and right-hand mounting on the printer so that the guide strips S can be removed from either or both sides of the printer sheet P, as shown in FIG. 1.

While the invention has been specifically described in connection with specific embodiments thereof, it is to be understood that this is by way of illustration and not of limitation, and the scope of the appended claims should be construed as broadly as the prior art will permit.

What is claimed is:

1. An apparatus for removing side edge guide strips from printer paper, comprising:

a first plate having a first planar main body portion and a first corner portion which is separated from the main body portion by a first narrow slit that extends from a front edge of the first plate toward a rear edge thereof, said first corner portion being angled away from said first planar main body portion;

a second plate having a second planar main body portion and a second corner portion which is separated from the second main body portion by a second narrow slit that extends from a front edge of the second plate toward a rear edge thereof, said second corner portion being angled away from said second planar main body portion; and means for rigidly attaching the first and second plates together in a spaced apart parallel relationship to one another so as to define a narrow slot therebetween wide enough to receive a marginal side edge portion of a printer paper with its side edge guide strip thereon through the slot, said first and second plates being attached together with said first and second corner portions facing each other and said first and second slits aligned with each other such that said corner portions create a path for the side edge guide strip that diverges abruptly from a path created by the main body portions for the marginal side edge portion of the printer paper, thereby causing the side edge guide strip to be torn from the marginal side edge portion.

2. The apparatus for removing side edge guide strips according to claim 1, wherein said means for attaching the first and second plates together comprises a segment that extends along and connects respective side edges of the first and second plates together.

3. The apparatus for removing side edge guide strips according to claim 2, wherein said first and second plates are integrally formed of a plastic material.

4. The apparatus for removing side edge guide strips according to claim 1, wherein said first corner portion has an inner edge defined by said first slit that passes across the narrow slot formed between the main body portions of the first and second plates and creates a shearing mechanism to facilitate removal of the side edge guide strip from the marginal side edge portion.

5. The apparatus for removing side edge guide strips according to claim 1, wherein said first and second plates are integrally formed from a single plate member which is folded back on itself to create the narrow slot, and wherein said first and second corner portions are formed by cutting said first and second slits in said plates and then bending said corner portions relative to said main body portions along a bend line perpendicular to said slits.

6. The apparatus for removing side edge guide strips according to claim 1, wherein said first and second corner portions have a width which is slightly larger than a width of the side edge guide strip.

7. The apparatus for removing side edge guide strips according to claim 1, wherein said first and second corner portions are angled relative to said main body portions along a bend line perpendicular to said slits.

8. The apparatus for removing side edge guide strips according to claim 1, further comprising an adhesive strip attached to a back side of one of said first and second plates for mounting the apparatus to a printer.

9. A device for removing side edge guide strips from printer paper, comprising:

first and second plate members which are secured together along one side in a spaced apart parallel relationship to one another with a narrow slot defined therebetween for receiving a printer paper having a marginal side edge portion and a side edge guide strip attached to the marginal side edge portion;

said first and second plate members each having a planar main body portion and a corner portion, said corner portions being delineated from said main body portions by respective narrow slits that extend from front edges of the plate members toward rear edges thereof and respective bend lines which are generally perpendicular to said narrow slits, said corner portions being angled relative to said main body portions about said bend lines so as to diverge away from respective parallel planes containing said main body portions;

wherein said corner portions cooperate together to create a first path for the side edge guide strip that diverges abruptly at said bend lines from a second path created by the main body portions for the marginal side edge portion of the printer paper, and wherein an inner edge of one of the corner portions passes closely across an outer edge of the narrow slot between the main body portions, whereby the side edge, guide strip can be removed from the marginal side edge portion using a combination of shearing and tearing forces without using moving parts and without using a cutting blade.

10. The device for removing side edge guide strips according to claim 9, wherein said first and second plate members are generally rectangular in shape and each have a front edge, a rear edge, and first and second side edges, and wherein the slit in each plate member extends perpendicular to the front edge from a position on the front edge between the first and second second side edges rearward to said bend line.

11. The device for removing side edge guide strips according to claim 9, wherein said first and second plate members are integrally formed of a plastic material.

12. The device for removing side edge guide strips according to claim 9, wherein said corner portions diverge from said main body portions at an angle of about 20 to 45 degrees.

13. The device for removing side edge guide strips according to claim 9, wherein said first and second corner portions each have a width which is slightly larger than a width of the side edge guide strip.

14. The device for removing side edge guide strips according to claim 9, further comprising an adhesive strip attached to a back side of one of said first and second plate members for mounting the device to a printer.

15. A printer for printing on a continuous sheet of paper having side edge guide strips formed on opposite side edges of the paper, comprising:

a paper outlet where the continuous sheet of paper is discharged from the printer after printing; and a guide strip removal system positioned at the paper outlet for removing the side edge guide strips from the printed paper as the paper is discharged from the outlet, said removal system comprising first and second guide strip removal devises positioned one on each side of the paper outlet, each guide strip removal device comprising:

first and second plate members which are secured together along one side in a spaced apart parallel relationship to one another with a narrow slot defined therebetween for receiving a respective marginal side edge portion and side edge guide strip of the discharged paper;

said first and second plate members each having a planar main body portion and a corner portion, said corner portions being delineated from said main body portions by respective narrow slits and bend lines, said narrow slits extending from front edges of the plate members toward rear edges thereof and said bend lines being perpendicular to said narrow slits, said corner portions being angled relative to said main body portions about said bend lines so as to diverge away from respective parallel planes containing said main body portions, said corner portions Cooperating to create a first path for the side edge guide strip that diverges abruptly at said bend lines from a second path for the marginal side edge portion, whereby the respective side edge guide strips are removed from the marginal side edge portions using a combination of shearing and tearing forces as the paper is discharged from the printer.

16. The printer according to claim 15, wherein each of said guide strip removal devices is provided with an adhesive mounting strip for attaching the device to an exterior surface of the printer.

17. The printer according to claim 15, wherein said guide strip removal devices are each positioned to direct the removed guide strips into a separate waste container as the paper is discharged from the printer.

18. The printer according to claim 15, wherein said first and second plate members of each guide strip removal device are generally rectangular in shape and have a front edge, a rear edge, and first and second side edges, and wherein the slit in each plate member extends perpendicular to the front edge from a position on the front edge between the first and second second side edges rearward to said bend line.

19. The printer according to claim 15, wherein said first and second corner portions of each guide strip removal device each have a width which is slightly larger than a width of the side edge guide strips.

20. The printer according to claim 15, wherein an inner edge of one of the corner portions passes closely across an outer edge of the narrow slot between the main body portions to impart a shearing force for separating the guide strips from the marginal side edge portions of the paper.

* * * * *